United States Patent [19]

Smith et al.

[11] 3,962,696

[45] June 8, 1976

[54] PROTECTIVE SYSTEMS

[75] Inventors: Ashtyn Hereward Smith, Carmarthenshire, Wales; John Egon Forbat, Hartley Wintney, England

[73] Assignee: Inertia Switch Limited, Hartley Wintney, England

[22] Filed: June 14, 1973

[21] Appl. No.: 369,956

[30] Foreign Application Priority Data

June 15, 1972 United Kingdom..... 28165/72

[52] U.S. Cl...... 340/276; 200/61.93; 340/274 R; 340/261; 340/409

[51] Int. Cl.²..... G08B 13/02

[58] Field of Search ..... 340/276, 261, 274, 409; 200/61.45 R, 61.93, DIG. 8, DIG. 9

[56] References Cited

UNITED STATES PATENTS

| | | | |
|---|---|---|---|
| 2,449,168 | 9/1948 | Kertz | 340/276 |
| 3,070,784 | 12/1962 | Strand | 340/274 |
| 3,531,793 | 9/1970 | Sottenfeld | 340/274 |
| 3,626,403 | 12/1971 | Ive | 340/276 |
| 3,665,259 | 5/1972 | Brailsford | 340/261 |

*Primary Examiner*—Glen R. Swann, III

*Attorney, Agent, or Firm*—Woodhams, Blanchard and Flynn

[57] ABSTRACT

A monitoring system for use as an intruder alarm comprises a sensor loop including at least one set of normally-closed contacts. An integrator circuit is coupled to the sensor loop and provides an alarm signal to an alarm when a set of contacts has been actuated for a predetermined period.

22 Claims, 2 Drawing Figures

PROTECTIVE SYSTEMS

BACKGROUND OF THE INVENTION

The present invention relates to monitoring systems such as vibration responsive systems and intruder protection systems for buildings and the like.

SUMMARY OF THE INVENTION

According to the present invention in one aspect there is provided a monitoring system comprising a circuit including at least one set of normally-closed contacts coupled in series between terminal means for coupling the circuit to a source of current and output means coupled to the circuit for providing, in use, a first output signal upon actuation of a set of contacts for a predetermined period, and means for varying the length of the predetermined period. Thus, the system could be arranged to provide an output signal after a relatively short period of actuation of one or more sets of contacts during a high security risk period, for example at night, and after a relatively long period during a low security risk period, during daylight hours for example.

Actuation of a set of contacts may be arranged to cause a change in the d.c. level of the current flowing in the circuit or to cause the current to oscillate or pulsate.

A set of normally-closed contacts may be arranged to change state from closed to open upon actuation or it may be arranged that the contacts alternate between the closed and open positions upon actuation to provide a plurality of pulses, or it may have one operative state in which the contacts alternate between the closed and open positions and another operative state in which the normally-closed contacts are opened and contact is made between one of the normally-closed contacts and a third, normally-open contact connected in parallel across the terminal means.

The source may provide a unidirectional or oscillatory current.

The output means may be a timer circuit for providing the first output signal after continuous actuation of a set of contacts for a predetermined period and including means for varying the length of the period.

The first output means may be an integrating circuit including means for varying the time constant of integration to vary the predetermined period.

The circuit may further comprise a set of normally-open parallel connected contacts and the output means may be arranged to provide a second output signal upon actuation of a set of normally-open contacts.

The output circuit may be arranged to provide a second output signal after continuous actuation of a set of normally-open contacts for a predetermined time.

The output signals may be used to operate separate alarms or the same alarm.

The output means may include means for rapidly resetting the level of the output signal upon deactuation of the switch contacts. By rapidly resetting is meant that the output means is reset in a period such that the output signal would be generated in the case of an abnormal occurrence such as a burglary but not in the case of a normal occurrence for example when a legitimate caller may knock on a door to which a set of contacts, such as vibration-sensitive contacts, have been fitted.

According to a second aspect of the invention there is provided a protective system comprising a circuit including at least one set of normally-closed contacts coupled in series between terminal means for coupling the circuit to a source of current and at least one-set of normally-open parallel connected contacts, output means coupled to the circuit for providing, in use, a first output signal upon actuation of a set of normally-closed contacts for a predetermined period, and for providing a second output signal upon actuation of a set of normally-open contacts.

The output means according to the second aspect of the invention may include means for varying the length of the predetermined period.

The output means according to the second aspect of the invention may be an integrating means.

In any of the preceding paragraphs relating to the second aspect of the invention:

1. The output means may include means for providing the second output signal upon actuation of a set of normally-open contacts for a predetermined period.

2. A set of normally-closed contacts may be arranged to change state from closed to open upon actuation or it may be arranged to vibrate between the closed and open states upon actuation.

3. The normally-closed and normally-open contacts may be an integral unit comprising a pair of contacts for connection in series in the circuit and a third contact for effecting a parallel connection, and movable means having a first position wherein it short circuits the said pair of contacts and another position wherein it short circuits one contact of the pair with the third contact. Thus the unit may be a conventional changeover switch or it may be a switch made by the Applicants and sold under the name of an Inertia Switch or an Inertia Sensor. Such a switch or sensor is disclosed in the specifications of U.K. Pat. Nos. 1,162,994 and 1,263,076.

4. The output means may include means for rapidly resetting the level of the first output signal upon deactuation of the switch contacts. By rapidly resetting is meant that the output means is reset in a period such that the first output signal would be generated in the case of an abnormal occurrence such as a burglary but not in the case of a normal occurrence for example when a legitimate caller may knock on a door to which a set of contacts such as vibration sensitive contacts have been fitted.

5. The system may include control means for causing the circuit to operate in alternative operative modes, wherein in one operative mode actuation of a selected one or more of the sets of contacts is rendered ineffective so that no output signal is provided and in the other operative mode actuation of any one or more sets of contacts causes the output means to provide a respective output signal. In a preferred arrangement the circuit is coupled to a source of direct current, the control means is arranged to reverse the direction of flow to change from one operative mode to the other and a respective unidirectional conducting device is connected across the normally-closed contacts of a selected set and/or in series with the normally-open contacts as the case may be.

6. The first and second output signals may be coupled to operate the same or different alarms as required.

BRIEF DESCRIPTION OF THE DRAWINGS

The invention will now be described solely by way of example with reference to the accompanying drawings, in which.

DETAILED DESCRIPTION

Figure 1:
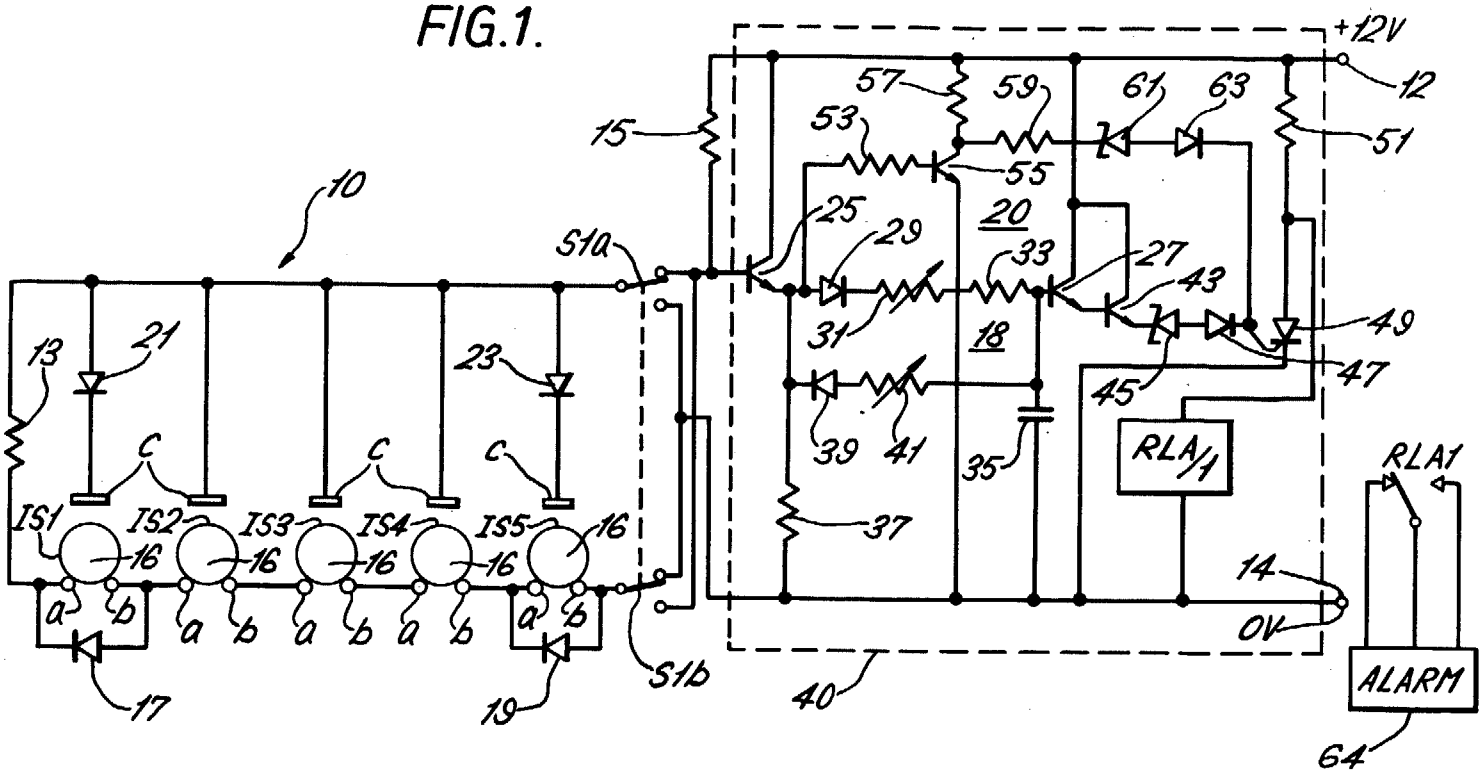
FIG. 1 is a circuit diagram of one embodiment of a monitoring system for use as an intruder protective system according to the invention.

Referring to FIG. 1 there is shown a protective system comprising a sensor circuit 10 comprising five sets IS1 to IS5 of sensors having normally-closed contacts *a* and *b* connected in series. Each sensor also has a normally-open contact *c*. The sets of contacts *a*, *b* are coupled through a resistor 13, a changeover switch S1*a* and a resistor 15 to a terminal 12, and through a changeover switch S1*b* to a terminal 14. The contact *c* of each sensor is connected in parallel across the circuit. In operation, the terminals 12 and 14 are connected to the positive and negative terminals respectively of a 12 volt source.

The sensors may be of the kind sold by our Assignees, Inertia Switch Limited under the name Inertia Switch or Inertia Sensor. Two such sensors are disclosed in U.K. Pat. Nos. 1,162,994 and 1,263,076. In operation if the sensor is fitted to a door of a room to be protected, interference to the door, such as continuous hammering or sawing to effect entry, will cause a conductive ball 16 to vibrate on the contacts *a*, *b* and hence produce intermittent open circuit conditions which will break up the direct current from the source into a series of pulses. If the door is opened then the ball 16 makes a circuit between its associated contacts *c*, *b*.

The switches S1*a* and S1*b* are ganged together so that in use the circuit 10 has two operative modes, in one mode current flows in a direction from IS1 towards IS5 and in the other current flows in a direction from IS5 to IS1.

Unidirectional conducting devices in the form of semiconductor diodes 17 and 19 poled as shown are connected across the contact sets IS1 and IS5 respectively and diodes 21 and 23 poled as shown are connected in series with the contacts *c* of respective sensors IS1 and IS5.

An output circuit shown within a broken line 40 comprising a first, integrating circuit 18 is coupled to the sensor circuit 10 between the junction of the switch S1*a* with the resistor 15. The integration circuit 18 comprises an NPN transistor 25 having its base connected to the junction of switch S1*a* with resistor 15, its collector connected to the terminal 12 and its emitter coupled to the base of an NPN transistor 27 through a diode 29 poled as shown, a variable resistor 31 and a fixed resistor 33. An integrating capacitor 35 is coupled between the base of transistor 27 and terminal 14. A resistor 37 is connected between the emitter of transistor 25 and the terminal 14. A diode 39 and variable resistor 41 are connected in series between the emitter of transistor 25 and the base of transistor 27. The components 37, 39 and 41 form a rapid reset circuit for the integration circuit as described hereinafter.

The capacitor 35 is coupled through a compound emitter follower circuit comprising NPN transistors 27 and 43, a Zener diode 45 and diode 47 poled as shown to the gate electrode of a silicon controlled rectifier 49, of which the anode is coupled through a resistor 51 to the terminal 12 and the cathode is connected to the terminal 14. The winding of a relay RLA/1 is coupled between the terminal 14 and the junction of the anode of the SCR 49 with resistor 51. The relay RLA/1 has changeover contacts RLA1 coupled to actuate an alarm 64 in one operative state of the relay.

In operation, the relay RLA/1 is normally energised. The output circuit 40 comprises a second circuit 20, coupled to the junction of S1*a* with resistor 15. The circuit 20 comprises the transistor 25, a resistor 53 coupled between the emitter of transistor 25 and the base of an NPN transistor 55, of which the emitter is connected to terminal 14 and the collector is coupled through a resistor 57 to the terminal 12 and through a resistor 59, a Zener diode 61 and a diode 63 (both poled as shown) to the gate electrode of the SCR 49.

In operation the value of resistor 13 is chosen such that the magnitude of the current through it and the normally-closed contacts of the sensor circuit 10 is a suitable value, say 100 micro-amps. The sensor would be fitted to doors, windows and the like of a room or building to be protected or to a perimeter fence around an area to be protected. The relay RLA/1 is energised through resistor 51.

With the switches as shown a current of about 100 micro-amps flows from the terminal 12 through resistors 15, 13, switch S1*a*, the sensors IS1 to IS5 and switch S1*b* to terminal 14. In this mode of operation diodes 17 and 19 are reverse biased and diodes 21 and 23 are forward biased. Under slight disturbing influences of, say a door associated with sensor IS5, the ball 16 of sensor IS5 will vibrate on the normally-closed contacts and the current through the circuit will be momentarily interrupted, larger disturnances will cause the ball 16 to short-circuit the normally-open contacts.

In the case of small disturbances the current through the sensor circuit will be interrupted and the voltage level at the base of transistor 25, the input to the integrator 18, will rise to charge the capacitor 35. If the disturbance continues for a predetermined period set by variable resistor 31 the capacitor will charge until it is at a level sufficient to fire SCR 49 by way of diodes 45 and 47. When the SCR fires it short circuits the winding of relay RLA/1. Relay RLA/1 is thus de-energised and an alarm is actuated.

If the disturbance is of sufficient magnitude to cause the ball 16 of a sensor to connect the normally-open contact, or the door etc. to which the sensor is fitted is opened then the base of transistor 25 is effectively short circuited to terminal 14. The voltage at the base of transistor 25 tends to Zero voltage and the SCR 49 is fired by way of the second circuit 20, to de-energise the relay. Thus a first output signal may be generated to fire SCR 49 when the normally-closed contacts are opened, and a second output signal is generated to fire SCR 49 when the normally-open contacts of a sensor are closed.

With regard to the operation of the integrating circuit 18 it is important that intermittent but unrelated ramdom disturbances are not continuously integrated to such an extent that the charge on the capacitor 35 increases until it reaches a value at which it fires the SCR 49. To prevent this a rapid run-down, or reset, circuit comprising resistor 37, diode 39 and variable resistor 41 is provided. The time constant of this circuit is selected such that abnormal occurrences such as occur when an attempt is made to break-in to protected premises actuate the alarm, but legitimate occurrences such as a person knocking at a protected door do not actuate the alarm. The variable resistor 41 is used to set the desired time constant.

Another important aspect of the invention is in the selection of the value of resistance of the resistor 13. The resistor may be a fixed resistor of preselected value or a variable resistor adjusted empirically to a threshold level whereby a person tampering with the circuit in such a way as to effectively place another resistance in series or in parallel with resistor 13 will alter the circuit characteristics to such an extent that the alarm is actuated.

In a second mode of operation the switches S1*a* and S1*b* are changed over to reverse the direction of flow of current through the sensors IS1 to IS5. In this mode of operation disturbances of sensors IS2, IS3, or IS4 will cause the alarm to operate as described but disturbance of sensors IS1 or IS5 is rendered ineffective by means of their associated diodes. Diodes 17 and 19 are forward biased effectively maintaining the short-circuit across their respective contacts, diodes 21 and 23 are reverse biased to maintain the open circuit in the parallel connections.

Thus the system could be operated in the first mode when it is desired that all of the sensors should be effective, during hours of darkness for example, and in the second mode when it is desired that selected sensors should be ineffective, during daylight hours for example.

Figure 2:
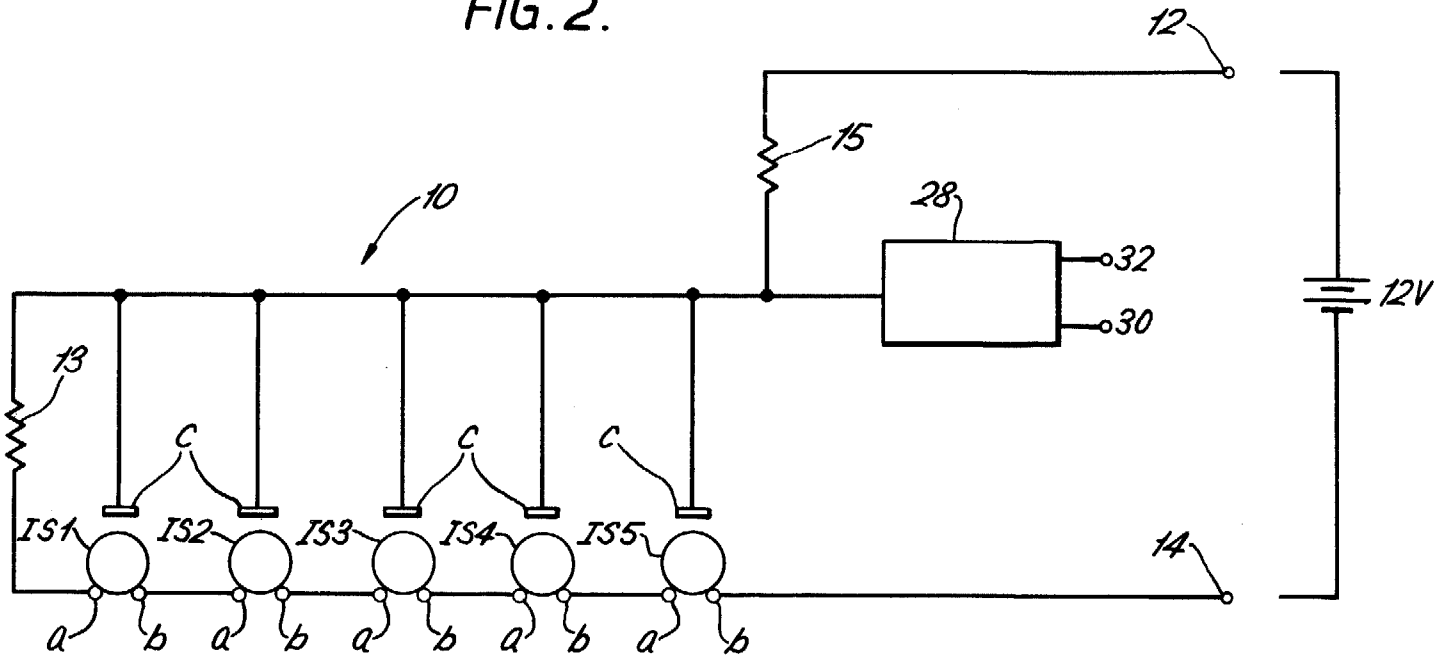
FIG. 2 is a schematic circuit diagram of another embodiment of a protective system according to the invention.

FIG. 2 shows a second embodiment of a protective system according to the invention comprising a sensor circuit 10 somewhat similar to that described with respect to FIG. 1. Connected to the junction of resistor 13 with resistor 15 is an output circuit 28 arranged to provide an output signal at a terminal 30 when any one or more of the normally-closed contacts of sensors IS1 to IS5 is actuated for a predetermined period. The circuit 28 includes a timer which can be adjusted to vary the length of the predetermined period to give two (or more) operative modes.

The circuit 28 includes a second output terminal 32 which provides a second output signal substantially instantaneously upon actuation of one or more of the sets of normally-open contacts of the sensor. Alternatively, the circuit could be so arranged that the second output signal is provided at terminal 32 after a set of normally-open sensor contacts have been actuated for a predetermined time.

While systems have been described for use with a source of direct current it is believed that systems according to the invention could be devised using a source of unidirectional pulsating current.

We claim:

1. A monitoring system comprising terminal means connectible to a potential source, a voltage divider connected between said terminal means and including first and second elements in series, a sensor circuit including at least one set of normally-closed contacts in series with said voltage divider between said terminal means and adjacent said second divider element, said sensor circuit further including at least one set of normally-open contacts in series with said first divider element and in parallel with said second divider element, and output circuit means coupled to the sensor circuit between said voltage divider elements and including a timer means and a first output terminal means for providing a first output signal upon actuation of a said set of normally-closed contacts at least for a predetermined period, said output circuit means further including a second output terminal means for providing a second output signal upon actuation of a said set of normally-open contacts, said timer means being adjustable to vary the length of said predetermined period.

2. A monitoring system according to claim 1, wherein said timer means comprises an integrating means energizeable for providing the first output signal after continuous actuation of a said set of normally-closed contacts for said predetermined period and means adjustable for varying the time constant of integration to vary the predetermined period.

3. A monitoring system according to claim 2, wherein the output means includes reset means for resetting the level of energization of the integrating means upon de-actuation of the corresponding normally-closed contacts.

4. A monitoring system according to claim 1, wherein a set of said normally-closed and normally-open contacts is an integral unit comprising a pair of said normally-closed contacts connected in series in the sensor circuit and a third normally-open contact, said unit further comprising movable means having a first position wherein it short circuits the said pair of contacts and another position wherein it short circuits one contact of the pair with the third contact and shunts said second divider element.

5. A monitoring system according to claim 4, wherein the terminal means is arranged to be coupled to a source of a unidirectional current, said divider elements being resistor means cooperable with said sets of contacts for varying the current flow in the sensor circuit in response to contact actuation.

6. A monitoring system according to claim 1, further comprising control means paralleling said second divider element for causing the sensor circuit to operate in alternative operative modes, wherein in one operative mode actuation of a selected one or more of the sets of contacts is rendered ineffective so that no output signal is provided and in the other operative mode actuation of any of said one or more sets of contacts causes its respective output means to provide an output signal.

7. A monitoring system according to claim 6, wherein the sensor circuit is coupled to a source of direct current, the control means including switch means actuable for reversing the direction of current flow to change from one operative mode to the other, said control means further including a unidirectional conducting device connected at at least one of first and second locations, said first location being across the normally-closed contacts of a selected set and said second location being in series with the normally-open contacts.

8. A monitoring system comprising a sensor circuit including at least one set of normally-closed contacts coupled in series between terminal means for coupling the circuit to a source of current and output means coupled to the sensor circuit for providing, in use, a first output signal upon actuation of a set of contacts for a predetermined period, and means for varying the length of the predetermined period, wherein a said set of normally-closed contacts is additionally associated with a third, normally-open contact connected in parallel across the terminal means and such set has a movable member having one operative state in which it vibrates between the closed and open positions of the normally-closed contacts and another operative state in which the normally-closed contacts are opened and contact is made between one of the normally-closed contacts and the third, normally-open contact.

9. A monitoring system according to claim 8, in which the third contact is spaced from the normally-closed contacts and said moveable member loosely occupies such space to permit said vibration thereof in said one operative state and thereby for causing the current through the sensor circuit to oscillate or pulsate.

10. A monitoring system according to claim 8, including indicating means, wherein the output means includes first circuit means for producing said first output signal coupled to the indicating means for operating same.

11. A monitoring system according to claim 10, wherein the output means includes second output circuit means for producing a second output signal coupled to said indicating means for operating same.

12. A monitoring system comprising:

terminal means connectible to a current source;

a sensor circuit including at least one set of contacts coupled in series with said terminal means and having a normal state and an actuated state;

output means coupled to said sensor circuit and terminal means and responsive to a selected threshold level for switching from a nonalarm state to an alarm state, integrating means coupled to said output means and energizeable to said threshold level, means for energizing the integrating means to said threshold level by continuous, repetitive vibratory actuation of a said set of contacts for a selected period, while precluding such energization by infrequent momentary actuation of the contacts, such energizing means including first time constant means coupled to said sensor circuit for energizing said integrating means at a first rate only while a said set of contacts is actuated and second time constant means for continuously deenergizing said integrating means at a second rate, said second rate being selected to be slower than said first rate.

13. A monitoring system according to claim 12 in which said set of contacts comprises a normally-closed pair of contacts of a switch unit, said contact pair being responsive to vibration for intermittently opening, said switch unit further including a third normally-open contact closeable with one of said pair of contacts upon substantial dislocation of the switch unit, said energizing means further comprising an electronic input means coupled to said sensor circuit and responsive to opening of said contact pair for applying an energizing voltage to said first time constant means, said electronic input means being responsive to closure of said third contact with said one contact for assuming a disabled state wherein said energizing voltage ceases.

14. A monitoring system according to claim 13 further including circuit means paralleling the connection of said integrator means between said electronic input means and output means and responsive to said disabled state of said electronic input device for substantially instantaneously actuating said output means, said output means comprising a normally energized output device and electronic switch means responsive to said threshold level for deenergizing said output device and thereby establishing said alarm state.

15. A monitoring system comprising:

terminal means connectible to a potential source;

a sensor circuit coupled to said terminal means and including at least one set of normally-closed contacts and at least one set of normally-open contacts, the normally open contacts being in series with each other and the normally closed contacts being in parallel with each other;

output device means connected to said terminal means and having first and second states, said first state corresponding to said normal states of said sensor circuit contacts;

output circuit means including first circuit means coupling said sensor circuit to said output device means and responsive to opening of one of said normally-closed contacts for shifting said output device means to a second state, and second circuit means also coupling said sensor circuit to said output device means, commonly and in parallel relation with said first circuit means, and responsive to closure of one of said normally-open contacts for independently shifting said output device means to its second state.

16. A monitoring system according to claim 15 in which said first circuit means comprises an integrating circuit, said integrating circuit including means chargeable to a first level for switching said output device means to said second state and means controlling the charging time for preventing said switching of state in response to infrequent momentary opening of said normally closed contacts.

17. A monitoring system according to claim 16 in which said chargeable means comprises a capacitor, said first circuit means further including adjustable means coupling a said capacitor to one of said terminal means for draining charge from said capacitor at a preselected rate so as to prevent charging of said capacitor to said first level by a series of momentary openings of said normally closed contacts occurring over a long period of time.

18. A monitoring system according to claim 16 including a resistive voltage divider connected across said terminal means and comprising first and second resistance means in series, said second resistance means being connected in series with said normally-closed contacts and in parallel with said normally-open contacts in said sensor circuit, a transistor having a base coupled to said voltage divider intermediate said first and second resistance means and having main current electrodes coupled across said terminal means, one said main electrode paralleling said first resistance means and the other main electrode being connected to the input end of each of said first and second circuits, whereby opening of one of said normally-closed contacts for a sufficient time causes said transistor to charge said chargeable means to said first level.

19. A monitoring system according to claim 18 in which said output circuit means includes electronic switch means actuable for shunting said output device means and having a control electrode for energizing same, said control electrode being connected to the output ends of said first and second circuit means.

20. A monitoring system according to claim 19 in which said second circuit means includes a conductive bias path to said switch means control electrode and transistor clamp means connected to said bias path and having a base coupled to said other main electrode of said transistor, said clamp means being normally energized to prevent switch means actuation by said bias path, said clamp means being deenergized in response to shut off of said transistor.

21. A monitoring system according to claim 19 in which said first and second circuit means each include isolating means coupling each to said control electrode but isolating the outputs of the first and second circuit means from each other, said first and second circuit means further including means in series with said isolating means thereof for blocking application thereby to said control electrode of circuit means output signals below a threshold magnitude.

22. A monitoring system according to claim 15 in which said output circuit means further includes a triggerable means responsive to generation of a trigger signal by either of said first circuit means and second circuit means for causing said shifting of said output device means to its second state, said first circuit means including timing means coupled to said sensor circuit and responsive to repetitive vibratory opening and closing of one of said normally-closed contacts, during a minimum duration of such vibration, for providing said trigger signal, said timing means being further responsive to a continuously open condition of said normally closed contacts sustained for a shorter minimum duration for providing said trigger signal, said second circuit means including means substantially instantaneously responsive to closure of a said normally-open contact for providing said trigger signal.

* * * * *